United States Patent [19]

Godbey

[11] 4,012,092

[45] Mar. 15, 1977

[54] ELECTRICAL TWO-WAY TRANSMISSION SYSTEM FOR TUBULAR FLUID CONDUCTORS AND METHOD OF CONSTRUCTION

[76] Inventor: Josiah J. Godbey, 812 Nottingham Drive, Richardson, Tex. 75080

[22] Filed: Mar. 29, 1976

[21] Appl. No.: 671,245

[52] U.S. Cl. ..... 339/16 R; 339/94 C

[51] Int. Cl.[2] ..... H01R 3/04

[58] Field of Search ..... 339/16 R, 15, 94 R, 339/94 C, 177 R

[56] References Cited

UNITED STATES PATENTS

| | | | |
|---|---|---|---|
| 3,184,706 | 5/1965 | Atkins | 339/94 C X |
| 3,253,245 | 5/1966 | Brandt | 339/16 R |
| 3,829,816 | 8/1974 | Barry et al. | 339/16 R |

*Primary Examiner*—Roy Lake
*Assistant Examiner*—DeWalden W. Jones
*Attorney, Agent, or Firm*—Joseph H. Schley; Thomas L. Cantrell

[57] ABSTRACT

An electrical two-way transmission system and method of constructing an electrical coaxial conductor assembly for a tubular fluid conductor composed of lengths of electrically conductive pipe having their ends connected in spaced relationship by external couplers, such as a well drill string having screwthreaded coupling collars connecting the ends of adjacent lengths of drill pipe, wherein said pipe and couplers provides an outer electrical conductor. An inner electrical conductor for the coaxial assembly is provided by tubes of thin ductile electrically-conductive material disposed within the outer conductor pipe, each inner conductor tube being electrically insulated from each pipe length by a complementary sheath of elastic dielectric liner material which envelopes said tube, the extremities of each sheathed tube being flared into conformity with the interiors of the end portions and transverse end faces of each pipe so as to anchor said tube against relative displacement, each sheathed tube being permanently deformed radially outward into contiguous conformity with each pipe interior and its end faces with each liner sheath expanded into sealing engagement therewith. An annular body of elastic dielectric material is disposed between the ends of adjacent pipe or within each pipe coupler and between the flared extremities of adjacent inner conductor tubes for insulating said tube extremities from adjacent pipe and coupler surfaces and has contact means for electrically connecting adjacent tubes to each other. The coupling of adjacent pipe deforms the annular body therebetween into fluid tight engagement with the tube extremities and adjacent pipe and coupler surfaces.

21 Claims, 13 Drawing Figures

ELECTRICAL TWO-WAY TRANSMISSION SYSTEM FOR TUBULAR FLUID CONDUCTORS AND METHOD OF CONSTRUCTION

BACKGROUND OF THE INVENTION

In the drilling of oil and gas wells, it is frequently necessary and/or desirable to transmit electrical power and/or signals from surface controls, measuring and/or recording devices to sensing or other electrical devices located in the lower portions or bottoms of boreholes. Usually, this communication is accomplished by lowering an insulated cable, with attached sensor or other device, through the drill string to the depth where the desired measurement or function is to be performed. This method necessitates discontinuance of the drilling operation, is time consuming and hence wastes expensive drilling time.

Ideally, the sensing or downhole device is prepositioned in the drill string, possibly in the lowest length of drill pipe or drill collar just above the drill bit with electrical communication to the surface being through a conductor system that is an integral part of each drill stem section. This concept is old and well known as illustrated by the expired patent to Polk, No. 2,000,716, which proposes an insulated coaxial inner conductor and uses the drill string as the outer electrical conductor of the system. Detachable insulated helical springs are used as connectors between adjacent sections of the inner conductor. However, Polk and other proposed system involve the engagement of coaxial insulated parts which are subject to irreparable damage under the rough handling associated with the coupling and uncoupling of drill pipe in well drilling operations. Furthermore, none of these systems provides a satisfactory method of mechanically securing the inner conductor and insulation in the drill stem so as to prevent dislocation under the rigors of well drilling.

Also, no means is provided to accommodate abrupt changes in the inner diameter of drill stem sections commonly located at the juncture of the drill pipe and its welded-on tool joints or coupling collars. If these diameter discontinuities are not remedied, the extreme fluid pressures encountered in deep well drilling can easily rupture both the inner conductor and its insulating material and thereby cause an electrical failure. These systems also fail to provide pressure seals at the tool joints which are adequate to prevent high pressure fluid from migration into the conductor-insulator interfaces causing high electrical leakage and possible separation of the inner conductor and its insulating sleeve from the drill pipe wall.

The faults of these previously conceived systems are overcome by a new conductor design and fabrication method as presented in this invention and provides all the following attributes of a viable, efficient electrical system:

1. Economical fabrication;
2. Installation in unmodified standard drill pipe;
3. Two-way electrical signal and/or power transmission;
4. High immunity to electrical noise, external or associated with the drilling operation;
5. Sufficient high speed signal and/or power transmission to permit duplex or multiplex operation of more than one signal or power circuit;
6. Applicability to any metallic pipe system incorporating mechanically connectable sections;

7. Negligible resistance to fluid flow in the pipe or drill stem;
8. Convenient means of electrical connection to both surface and to the drill stem instrumentation; and
9. Capable of a slip-ring tubing connection between the drill kelly and top rotary joint so as to permit downhole monitoring or control while drilling.

SUMMARY OF THE INVENTION

Although this invention is particularly applicable to well drill stems or strings, it is adapted to be used in conjunction with other types of tubular fluid conductors composed of lengths of electrically conductive pipe having their adjacent ends connected in spaced relationship by external couplers whereby the transverse faces and interiors of the end portions of said pipe remain accessible and thereby permit the use of this invention therewith. When the external couplers are of the screwthreaded pin and box type, made integral with or secured to the exteriors of the end portions of each length of pipe, said end portions of said pipe include all of the pin type coupler and only the inner end and medial web portions of the box type coupler. In some fluid conductors, each external coupler consists of a single box type of receiving the pin end of the adjacent pipe.

In carrying out this invention, the lengths of drill pipe and the tool joints or coupling collars of a drill stem or string are adapted to be utilized as the outer or first of the coaxial electrical conductor of an electrical two-way transmission system between the drilling platform or derrick floor at the surface of the well and the lower portion or bottom of the borehole. Various electrical means, such as motors, recorders, sensors or other instruments, mounted within the drill collar or sub immediately above the drill bit and at the surface or at remote points in other tubular fluid conductors composed of lengths of pipe having external couplers at their ends for connection with one another, are adapted to be electrically connected by the transmission system. The inner or second of the electrical conductors is disposed within the pipe of the outer conductor and is tubular, being of a diameter slightly less than the internal diameter of said pipe so as to have its exterior in spaced close proximity to the bore or internal wall of said pipe with a liner or sheath of dielectric or electrical insulating liner in sections of complementary lengths whereby the sections or tubes of said inner conductor and the sections or sheaths of said liner are coupled and uncoupled simultaneously with said drill pipe and their tool joints.

The efficiency of an electrical transmission system of this type is dependent, in part, upon the positiveness of the detachable connections, both mechanically and electrically, between the tubes of the inner conductor when the drill string is made up, it being necessary to repeatedly break down and remake said drill string, such as when changing drill bits. Therefore, these detachable connections must be of such construction that they will conduct electrical current between adjacent tubes of the inner conductor and insulate, or seal off, electrically as well as mechanically, the terminal ends of said inner conductor tubes from the contiguous interior surfaces of the tool joints of the drill pipe even after numerous coupling and uncoupling thereof. Of equal, if not greater importance, is the durableness of the electrical coaxial condition provided by each length of pipe, its complementary inner conductor tube and the liner sheath of insulating material interposed therebetween which provides a fluid-tight seal between the inner and outer coaxial conductors of each length or section of a tubular fluid conductor.

Each sheath of the insulating liner (which is interposed between the inner and outer conductors) as well as each tube of said inner conductor are of greater length than each length of drill pipe and its pin type coupling collar so as to extend from the outer extremity of the lower or outer male or pin end of said coupling collar (which is secured to the lower or one end of said pipe) upwardly through said pipe and to and through the box at the inner or lower end of the female or box type coupling collar (which is secured to the opposite or upper end of said pipe) to the inner end or bottom of the box at the outer or upper end of said female coupling collar, which outer box is adapted to receive the pin end of the pipe length immediately thereabove. Each liner sheath is of slightly greater length than the inner conductor tube which it envelopes, whereby the extremities of said liner sheath project beyond the ends of said tube so as to assist in preventing short circuiting between the inner and outer electrical conductors of the electrical coaxial conductor assembly at the joints of its length or sections. Each tube of the inner conductor is formed of suitable metal, such as annealed copper, or other erosion-resistant material capable of conducting electrical current with minimum resistance, of sufficient thinness and ductility to facilitate the radial outward deformation thereof into conforming contiguity with the inner wall of each pipe by mechanical and/or fluid pressure means, as will be apparent hereinafter.

Each sheath of the insulating liner is adapted to snugly envelope the exterior of each tube of the inner conductor prior to the mounting of said sheathed tube within each pipe. The dielectric insulating material of each liner sheath must be of sufficient elasticity to permit radial expansion thereof, while maintaining its integrity, with the radial outward deformation of the inner conductor tube and into fluid-tight sealing engagement with the inner wall of each pipe. In addition to providing a continuous uniform electrical insulator and a pressure fluid barrier between the inner and outer conductors, this dielectric material must have extremely high chemical resistance as well as very low liquid absorption and must retain these characteristics over the extreme ranges of temperatures and pressures encountered during the drilling of deep wells.

Each pipe length, its inner conductor tube and insulating liner sheath coact to form an integral rigid coaxial electrical conductor unit; and each pipe length, as used herein, comprises the male or pin type coupling collar secured to one end of each pipe and the inner end and medial web portions only of the female or box type coupling collar. In effect, only the outer box of each female coupling collar functions as an external coupler, whereby one end of the aforesaid pipe length terminates at the inner end or bottom of said outer box of said female coupling collar and said box bottom functions as one of the transverse or end faces of each pipe length. For maintaining each conductor tube and liner sheath against displacement, both ends thereof are mechanically flared into substantial conformity to the interior and transverse faces of the end portions of each pipe length. It is emphasized that the slightly greater length of each sheath permits its extremities to project beyond the flared ends of each tube so as to ensure that said flared ends do not contact the adjacent interior of each pipe length, The tools for flaring the ends of each conductor tube include cylindrical plugs of suitable diameter for mechanically deforming the portions of said tube adjacent its ends radially outward into engagement with the internal wall of its respective pipe length. Since these plugs close the ends of the tube, fluid under pressure forced into its interior deforms the remaining or major intermediate portion of said tube with its sheath radially outward into conformity with the internal surfaces of the pipe length.

Due to the annular recesses between the ends of each pipe and the adjacent bottoms or inner ends of the inner boxes of the male and female coupling collars secured thereto, the pressure fluid expands the conductor tube and its sheath into annular beads which project into said recesses so as to assist in anchoring said tube against displacement When adjacent lengths of pipe are coupled, the lower or outer extremity of the pin of the lower coupling collar of the upper drill pipe length is spaced from the bottom of the outer or upper box of the female coupling at the upper end of the lower pipe length whereby the adjacent ends of the respective inner conductor tubes of said adjacent pipe lengths are spaced from each other.

For bridging this space, combination electrical connector-insulator-packer means in the form of an annular plug or collar is provided and is composed of a pair of annular metallic end members or rings connected to each other in spaced relationship by a metallic helical member or spring and embedded in an annular body of dielectric elastic material. This body is of greater axial length than radial thickness or width and has an external diameter slightly greater than the diameter of the bottom or inner end of the outer or upper box of the female coupling collar of the upper end of each pipe length, said body having approximately the same internal diameter as the bore of the tube mounted in said pipe length. A suitable tool is provided for inserting the annular plug into the female coupling collar box and deforming the body thereof into engagement with the screwthreaded wall of said box so as to impart rotational threaded movement thereto and thereby assist in seating said body. It is noted that the helical spring and its attached end rings of the combination connector collar are disposed in the internal peripheral margin of the body so as to not interfere with the radial deformation of said body as well as facilitate its insertion.

The method of this invention comprises the construction of an electrical coaxial conducting assembly or system for transmitting electrical power between remote points in tubular fluid conductors, such as pipe lines and well drill strings, composed of lengths of pipe having their adjacent ends connected in spaced relationship by external couplers, such as screwthreaded pin and box coupling collars, wherein the pipe lengths are utilized as the outer electrical conductor of the coaxial conducting system. The inner electrical conductor of this system is formed of a multiplicity of tubes generally complementary to the pipe lengths and of metallic or other electrically conductive material having sufficient ductility and thinness to permit permanent radial outward deformation thereof into contiguous conformity with the interior surface of said pipe lengths after being positioned therein. Each tube of the inner conductor is enveloped prior to such positioning by a complementary sheath of dielectric or electrical insulating elastic material and of slightly greater length so as to project beyond the ends of said inner conductor tube, the elasticity of the dielectric material permitting each sheath to expand radially with said radial outward deforming of said tube into sealing engagement with the inner wall of each pipe length. Each inner conductor tube is coextensive with its pipe length from the outer extremity of its pin end to the bottom or inner end of its box end, the ends of each inner conductor tube being mechanically flared into conformity with the interior of said outer extremity of said pin end of said pipe length and with the interior of said pipe length adjacent its box end prior to said outward radial deforming of said tube. The aforesaid screwthreaded connection of the pin and box ends of adjacent pipe lengths provides an annular recess therebetween at the bottom or inner end of each box and into which recess complementary portions of each tube and sheath are deformed, the inner conductor being completed by mounting combination connector-insulator-packer means in each recess between adjacent ends of said tubes, the latter means being in the form of an annular plug composed of an annular body of suitable elastic material having electrical contact means therein as described hereinbefore.

When the pipe lengths are unthreaded and are connected by other types of couplings, such as clamps or unions, the ends of adjacent lengths of pipe are spaced from one another when coupled and one of the combination connector-insulator-packer means is interposed between said adjacent spaced pipe ends. Also, the ends of the inner conductor tubes and liner sheaths are flared over the ends of the pipe lengths for coaction with the aforesaid combination means.

DESCRIPTION OF A PREFERRED EMBODIMENT

Figure 1:
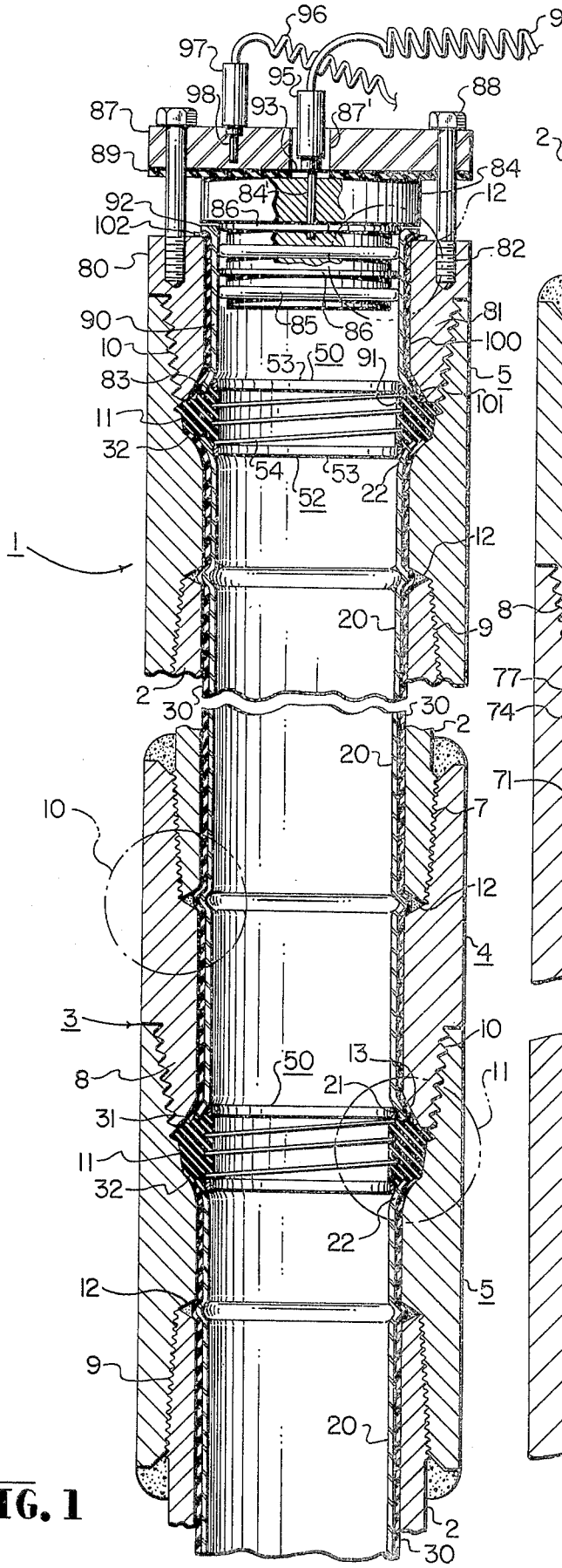
FIG. 1 is a broken longitudinal sectional view, partly in elevation, of the upper end portion of a drill stem or string having an electrical two-way transmission assembly or system constructed in accordance with the invention and showing combination electrical connector-insulator-packer means in the form of annular plugs or collars interposed between the ends of adjacent sections or tubes of the inner electrical conductor of said transmission system and in deformed sealing position, and showing the outer electrical conductor of the system provided by the lengths of drill pipe and tool joints of the drill string as well as the rigid coaxial conductor formed by the coaction of each drill pipe length with the complementary section or tube of said inner conductor and its corresponding insulating liner section or sheath.
Figure 2:
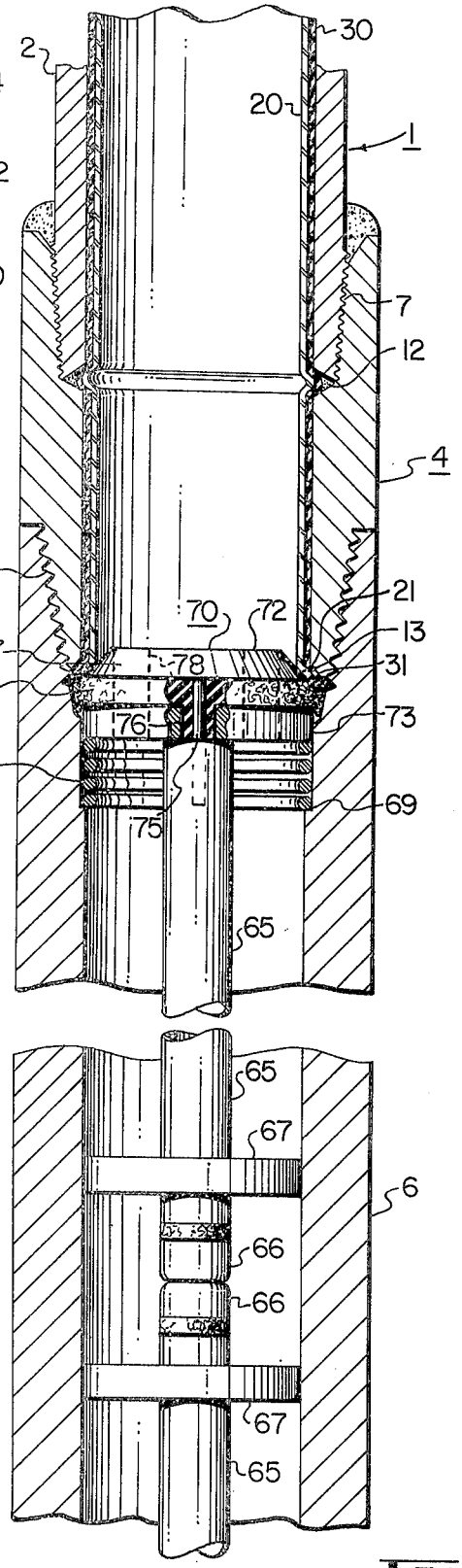
FIG. 2 is a view, similar to FIG. 1, of the lower end portion of said drill stem or string and its electrical signal transmission system, showing a second combination electrical connector-insulator-packer means between the lowermost inner conductor tube of said transmission system and instrument means mounted in the drill collar or sub immediately above the drill bit.

In the drawings, the numeral 1 designates a portion of a drill stem or drill string composed of a multiplicity of lengths of drill pipe 2 having externally screwthreaded ends interconnected by tool joints 3 which comprise male and female coupling collars 4, 5 secured to opposite ends of the drill pipe and coacting therewith to form the pipe. As shown in FIGS. 1, 2, the coupling collars 4, 5 may be screwthreaded upon and then welded to the pipe lengths 2 with the lowermost male coupling collar 4 having screwthreaded connection with an elongate drill collar or sub 6, to the lower end of which (FIG. 2) the usual drill bit (not shown) is adapted to be detachably secured. Each of the male coupling collars has a screwthreaded box or socket 7 at one end for connection with one of the externally screwthreaded ends of each pipe and an externally screwthreaded pin 8 at its opposite end, the upper box end of the drill collar 6 being threaded on the pin end of the lowermost pipe length. Each of the female coupling collars 5 has a pair of opposed screwthreaded boxes or sockets 9, 10, the inner one 9 of which boxes is adapted to receive the externally screwthreaded pipe end to which is is also welded. The other or outer box 10 receives the screwthreaded pin 8 of the male coupling collar 4 of the adjacent pipe length 2. It is noted that the outer end or extremity of the pin of each male collar is spaced from the inner extremity or bottom of the box 9 of each female collar, as shown at 11 in FIGS. 1, 8, 11, when said collars are coupled and that said box extremity or bottom functions as one of the transverse or end face of each pipe length. A smaller annular space or recess 12 is provided between the inner extremity or bottom of each box 7 of each male collar 4 as well as between each inner box 9 of each female collar and the extremity of the respective pipe screwthreaded thereinto and secured thereto. This structure illustrates a typical drill string and is subject to variation. As shown at 13 in FIGS. 1, 7, 11, the interior extremity of the pin end 8 of each coupling collar 4 may be bevelled during manufacture.

The two-way electrical transmission system of the present invention is adapated to be applied to the drill string 1 and involves the construction of an electrical coaxial conductor assembly wherein the drill pipe 2, coupling collars 4, 5 of the tool joints 3 and the drill collar 6 are utilized as the outer electrical conductor of the assembly. The surface portion of the two-way transmission system has not been shown in view of the electrical surface connection of the expired patent to Polk, U.S. Pat. No. 2,000,716 which includes a rotary table, drive mandrel or kelly joint, slip ring and swivel in addition to an electrical coaxial conductor of the same general type. The inner electrical conductor of the two-way transmission system of this invention is adapted to be in electrical contact with a similar slip ring (not shown) and is composed of a multiplicity of tubular sections or tubes 20 of thin ductile electrically conductive material, such as annealed copper, aluminum or other metal having high ductility, high electrical conductivity and high resistance to corrosion, errosion or other deterioriation. One of the tubes 20 is adapted to be mounted in each pipe length 2 and is complementary thereto, being slightly longer than said pipe length including its male coupling collar 4 and the inner end and medial web portions of its female coupling collar 5. For electrically insulating each inner conductor tube from the pipe length in which it is mounted, said tube is enveloped by a complementary liner section or sheath 30 of elastic dielectric material prior to insertion in said pipe length.

In addition to providing continuous insulation throughout the entire length of each tube 20, the material of each liner sheath 30 must maintain its integrity during expansion and contraction, must be highly resistant to chemicals encountered in drilling oil wells, have very low liquid absorbtion, provide a pressure fluid barrier between each pipe length and tube and retain these characteristics over extreme ranges of temperatures and pressures. The liner sheaths may be formed of tubing or sleeves, such as heat shrinkable polyolefin irradiated tubing, shrunk fit upon the tubes or be applied by spray coating or by winding tape upon said tubes.

Figure 10:
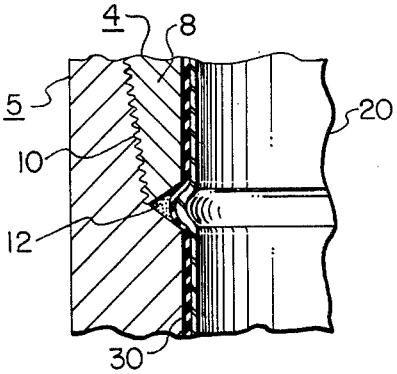

In order to ensure adequate electrical insulation at the ends of each tube 20, each sheath 30 is of slightly greater length than the tube upon which it is shrunk fit or otherwise applied so that the extremities 31, 32 of said sheath project a slight distance beyond the end portions 21, 22 of said tubes. It is necessary for the external diameter of each enveloped or sheathed tube to be sufficiently smaller than the bore of each pipe length (shown inverted in FIG. 7) to permit insertion thereof readily into said pipe length. After positioning within each pipe length 2, the end portions 21, 22 of each tube 20 are flared into contiguous conformity with the interior and transverse face of the outer extremity of the pin end 8, including the bevel 13 of the male collar 4, and the inner extremity or transverse face 11 of the outer box or socket end 10 of the female collar 5 of said pipe length. Of course, the elasticity of each sheath 30 permits its end portions 31, 32 to expand with the flared end portions 21, 22 of each tube and engage the interior surfaces of the aforesaid pin and box ends of the pipe length. As a result, each tube and its sheath are anchored to each pipe length so as to prevent relative longitudinal displacement therebetween. Prior to insertion of the tube 20 and sheath 30 within the pipe length, it is desirable to remove projections from the inner wall of said pipe length and to fill the annular spaces 12 with a suitable mastic or packing ring so as to reduce the depth and angularity of said spaces (FIG. 10). This is essential when the end surfaces of the pins and the bottoms of the boxes are not bevelled or tapered sufficiently and/or present acute edges which might cause rupturing of the adjacent portions of the liner sheath and tube.

Figure 7:
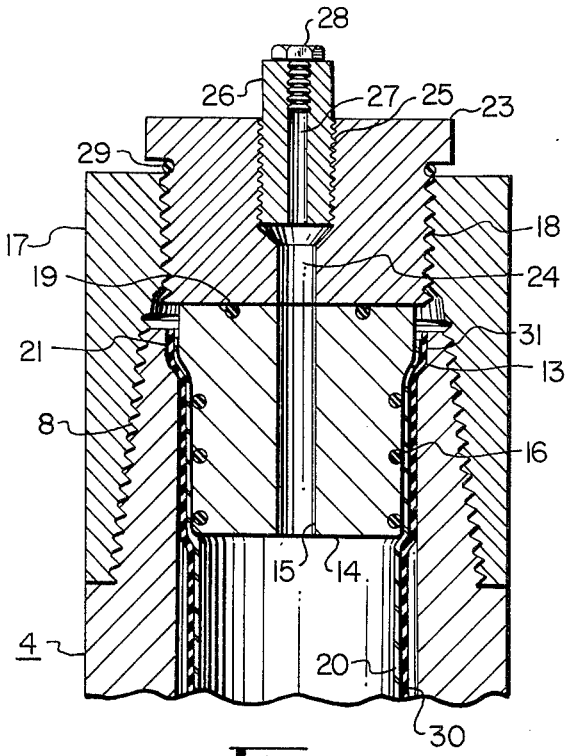
FIG. 7 is a transverse vertical sectional view, in inverted position, of the lower or pin end of the coupling collar at the lower end of each length of drill pipe, illustrating the radial flaring of the lower end portion of each tube of said inner conductor of said transmission system into conformity with the interior contour of said pin of said collar and the plugging of said lower end collar of said drill pipe length preparatory to the outward deformation by fluid pressure of said inner conductor tube between its extremities into contiguous conformity with the interior of said drill pipe length.

As shown in FIG. 7, the lower end portion 21 of each tube is adapted to be deformed into the aforesaid conformity by a cylindrical plug 14 having an exterior complementary to the interior of the pin end 8 and its bevel 13 of each coupling collar 4 and being of a length sufficient to extend into said collar interior a distance much greater than the axial width of said bevel. An axial passage 15 extends through the plug 14 for communicating through the interior of the male collar with the bore of the tube 20; and spaced annular packing or O-rings 16 surround said plug for sealing engagement with said tube bore. In order to facilitate insertion of the plug into the tube, an annular cap 17 is screwthreaded onto the pin end of the collar 4 and has a reduced screwthreaded bore 18 in its outer or upper portion of greater diameter than said plug. A cylindrical flanged follower 23 is adapted to be screwthreaded into the bore 18 of the cap 17 for forcing the plug 14 into the tube and has an axial port 24 communicating with the passage 15 of said plug. An annular packing or O-ring 19 is recessed in the top or outer end of the plug in surrounding relation to its passage for sealing engagement with the bottom or inner surface of the flanged follower 23. As shown at 25, the outer portion of the follower bore 24 is enlarged and screwthreaded for receiving a complementary tubular fitting 26 which has its axial bore or passage 37 closed by a removable cap screw 28. An annular packing or O-ring 29 is adapated to be mounted beneath the flange of the follower 23 for sealing off between said plug and the outer end or top of the cap 17.

Figure 8:
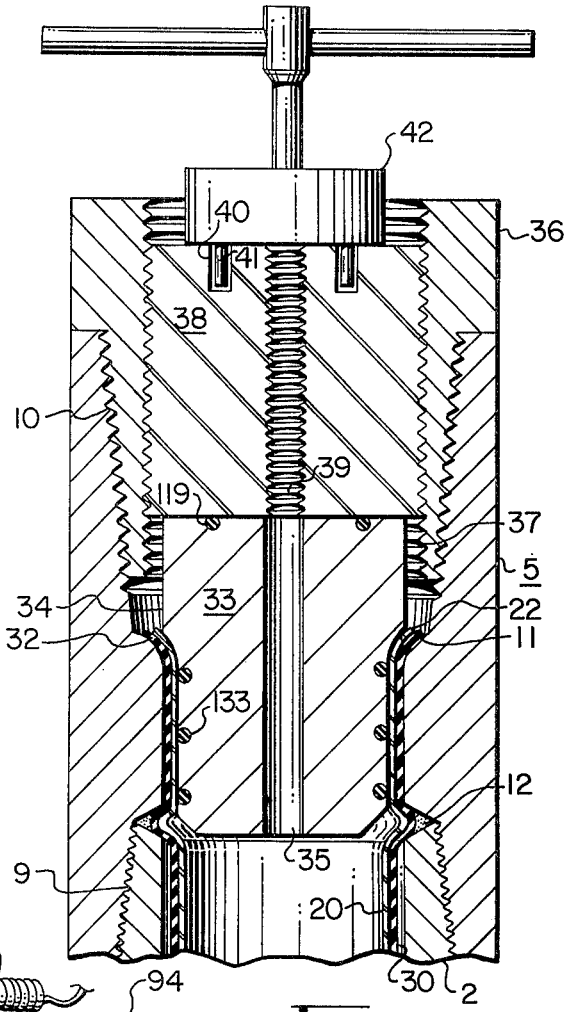
FIG. 8 is a view, similar to FIG. 7, showing the radial flaring of the upper end portion of each inner conductor tube into conformity with the interior contour of the medial portion of said female coupling collar at said upper end of each drill pipe length as well as the plug for said collar during said outward deformation of said inner conductor tube between its extremities.

As illustrated in FIG. 8, the upper end portions 22 and 32, respectively, of each tube 20 and its sheath 30 are adapted to be flared into conformity with the inner extremity 11 of the outer or upper box 10 of each female coupling collar 5 by an elongated cylindrical plug 33 having an inner or lower portion complementary to and adapted to project inwardly beyond said box 10 into the interior of the pipe length 2 screwthreaded into and secured to the other or inner box end 9 of said collar. An annular shoulder 34 is provided at the medial portion of the plug 33 for complementary engagement with the inner extremity 11 of the coupling collar box 10; and an axial passage 35 extends through said plug so as to communicate with the bore of the tube 20. The inner portion of the plug has spaced annular packing or O-rings 133 recessed in its exterior for sealing engagement with the tube bore. For forcing the plug 33 into the tube 20, an annular flanged nipple 36 is screwthreaded into the outer box 10 of the female coupling collar and has the outer portion of its bore 37 screwthreaded for receiving a follower 38. The latter has an axial screwthreaded port 39 communicating with the outer end of the axial passage 35 of the plug 33; and a pair of diametrically aligned axially extending recesses 40 are formed in the top or outer surface of the follower 38 for receiving the prongs 41 of a suitable hand tool or wrench 42 to impart rotation to said follower. Due to the inward projection of the plug 33 into the bore of the tube 20 past the inner extremity 11 of the outer or upper box 10 of the coupling collar 5, the portion of said tube surrounding the inner portion of said plug is deformed radially outward into conformity with the bore or web of said coupling collar interior of the outer extremity of the pipe end screwthreadedly engaged in the other or outer box 9 of said collar. An annular packing or O-ring 119, similar to the O-ring 19 of the plug 14, is recessed in the outer end or top of the plug 33 so as to encircle the passage 35 of said plug and engage the inner end or bottom of the follower 38 for sealing off between said passage and the bore of the flanged nipple 38.

The extent of this inward projection, like that of the plug 14 into the pin end 8 of the male coupling collar 4 at the opposite end of each pipe length 2 as shown in FIG. 7, is sufficient to prevent accidental displacement of the sheathed tube 20 during subsequent handling of said pipe length and prior to the radial outward deformation of the entire length of said tube between its end portions into conformity with the interior of said pipe length. It is noted that it is immaterial which end of the sheathed tube is the first to be flared and that each extremity 21, 22 of said tube must be at least partially spread in order to accommodate insertion of the plug 14, 33. Due to its screwthreading, the port 39 of the follower 38 may be closed by a suitable cap screw — which is not illustrated but which may be similar to the cap screw 28 engaged in the port 25 of the fitting 26 mounted in the bore 27 of the flanged follower 23 at the outer or opposite end of the pipe length — after removal of the wrench tool 42; or said follower 38 may be removed to permit the substitution of a flanged follower (not shown) similar to said follower 23 so as to more positively seal off the outer or upper end 22 of said tube.

With both ends of the sheathed tube 20 of each pipe length 2 being closed, one of the cap screws 26 is removed to permit the application of fluid under pressure from a suitable source (not shown) through one of the ports 25, 39 to the interior of said tube so as to force said tube radially outwardly into contiguous conformity with the bore of said pipe length. Also, each sheathed tube is deformed into the annular spaces or recesses 12 at the bottom or inner end of the outer or upper box 7 of each male coupling collar 4 and at the bottom or inner end of the inner or lower box 9 of each female coupling collar 5 as complementary annular beads. As stated hereinbefore, these annular spaces or recesses are filled with a suitable mastic or packing ring to decrease the angularity and depth thereof. Due to its elasticity, each sheath 30 not only clings to the exterior of its tube 20 but expands therewith into sealing engagement with the inner wall of its pipe length 2 and the lower recesses 12 thereof.

Figure 11:
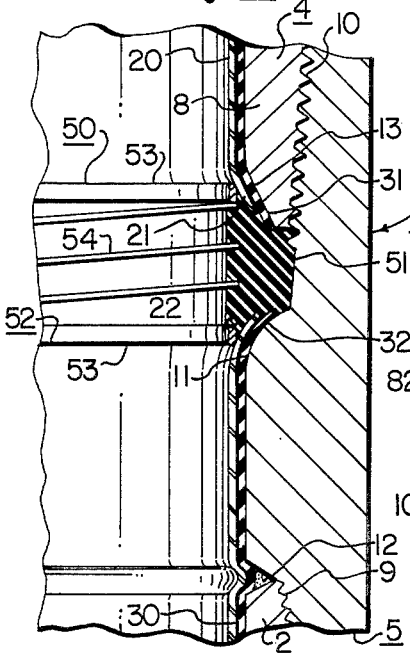
FIG. 11 is a view, similar to FIG. 10, of the circled portion 11 of FIG. 1, showing the deformation of one of the combination annular plugs into sealing engagement with said flared end portions of adjacent inner conductor tubes as well as the contiguous internal surfaces of said coupling collars of one of said tool joints.

Since the respective upper extremities 22, 32 of each tube 20 and sheath 30 terminate at the bottom or inner end of the outer or upper box 10 of the female coupling collar 5 of each pipe length 2 as shown at 11 in FIGS. 1, 8, 11, said upper extremities are spaced from the lower or inner extremity of the male coupling collar 4 attached to the lower end of the pipe length immediately thereabove and engaged in said box 10 of said collar 5 as well as from the lower extremities 21, 31 of the tube and liner sheath mounted in the latter pipe length. In order to bridge this space, a combination electrical connector-insulator-packer means in the form of an annular plug or ring 50 (FIGS. 1, 3, 4, 11) is provided and includes an annular body 51 of elastic electrical insulating or dielectric material capable of being deformed into sealing engagement with the contiguous interior surfaces of the pin end 8 of the coupling collar 4 and the box 10 of the female collar 5 of each tool joint 3 as well as the tube extremities 22, 21 and the adjacent extremities 32, 31 of the liner sheath 30.

Figure 3:
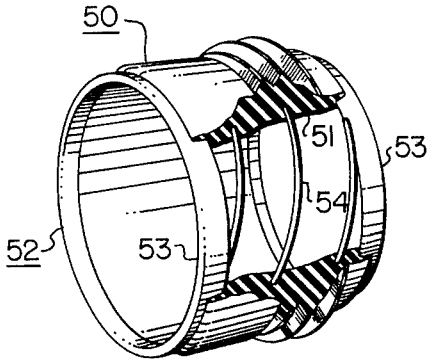
FIG. 3 is a perspective view, partly in section, of one of said combination connector-insulator-packer means or annular plug in relaxed normal condition.
Figure 4:
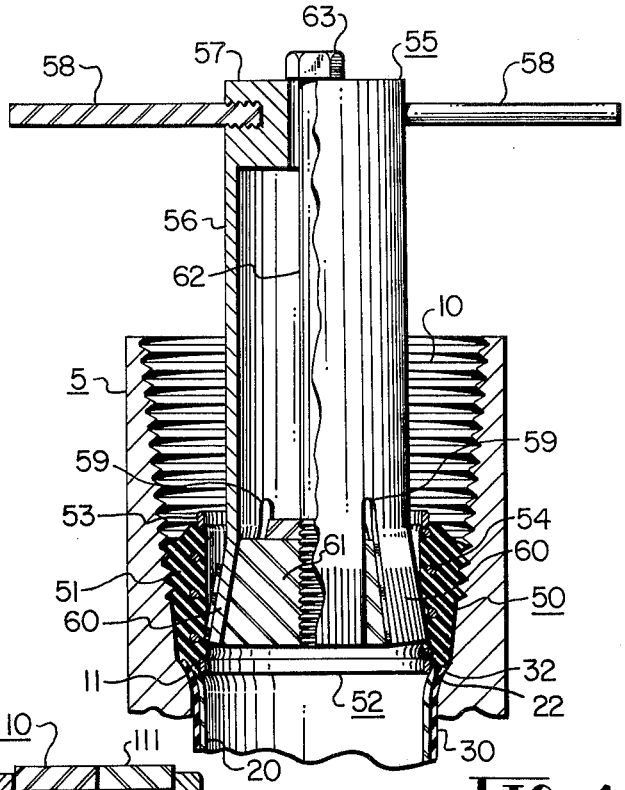
FIG. 4 is a transverse vertical sectional view, partly in elevation, of the upper end portion of one of the female coupling collars at the upper end of each length of drill pipe of said drill string, illustrating the insertion of one of the combination connector-insulator-packer or annular plug into the upper box of said female coupling collar in seating engagement with the flared upper extremity of each inner conductor tube of said electrical transmission system and the deformation of said annular plug into conformity with the contour of the bottom portion of said upper box of said collar.

As best shown in FIGS. 3, 4, the annular connector-insulator-packer body 51 is of much greater axial length than radial thickness or width and has an electrical conductor 52 embedded or molded in its inner peripheral portion and coextensive therewith for contact with the adjacent extremities of adjacent tubes 20. Preferably, the electrical conductor 52 is in the form of a pair of annular end members or rings 53 connected to each other in spaced relationship by a helical member or spring 54. The rings 53 and spring 54 are constructed of suitable electrically conductive metal and said rings are of greater axial width than radial thickness so as to resist axial bending or flexing thereof. Also, the rings are of greater internal diameter than the tubes 20 so as to engage the inner portions of the flared ends 21, 22 thereof. In its normal relaxed or undeformed condition, each annular plug 50 has an external diameter slightly greater than the diameter of the bottom or inner end of box 10 of each female coupling collar 5 into which said plug is adapted to be seated by a suitable tool 55.

As shown in FIG. 4, the tool 55 includes a cylindrical tubular member or sleeve 56 having an internal annular relatively thick head or flange 57 at its outer or upper end and a pair of opposed radial arms 58 projecting laterally from said outer end to facilitate manual rotation of the sleeve. A multiplicity of equally-spaced longitudinal slots 59 are cut in the lower end portion of the sleeve 56 to provide flexible fingers 60. For flexing the fingers outwardly, a frusto-conical wedge element 61 has screw-threaded connection with the lower end of an axial bolt 62 which extends longitudinally of the sleeve 56 with its head 63 overlying the head 57 of said sleeve. The upper or inner end of the wedge element 61 is of less diameter than the bore of the tool sleeve 56 so as to permit insertion of said inner end of said wedge element into the lower end of said sleeve bore for its screwthreaded connection with the inner or lower end of the bolt 62. Also, the external diameter of the sleeve is substantially equal to the internal diameter of the annular body 51 of the plug 50 whereby said sleeve may be inserted into the bore of said body and detachably fastened to said plug by rotating the bolt 62 of the tool 55 relative to the wedge element 61 and said sleeve so as to expand its fingers 60 into positive frictional engagement with said body and thereby facilitate mounting of said plug in the outer or upper box 10 of the female coupling collar 5.

Since the plug body is of slightly greater diameter than the bottom or inner end of the latter coupling collar box, it is necessary to screw said body into seating engagement with said box bottom by rotating the tool. It is pointed out that the extent of the expansion or outward flexing of the fingers 60 of the sleeve 56 is exaggerated in FIG. 4 and that only a slight expansion is required to fractionally fasten said sleeve to the annular body 51 of the plug 50. Upon backing off of the wedge element 61 relative to the sleeve, the fingers of the latter flex inwardly to permit removal of the tool from the annular plug which remains seated and partially deformed in the inner end portion of the coupling collar box 10.

Figure 5:
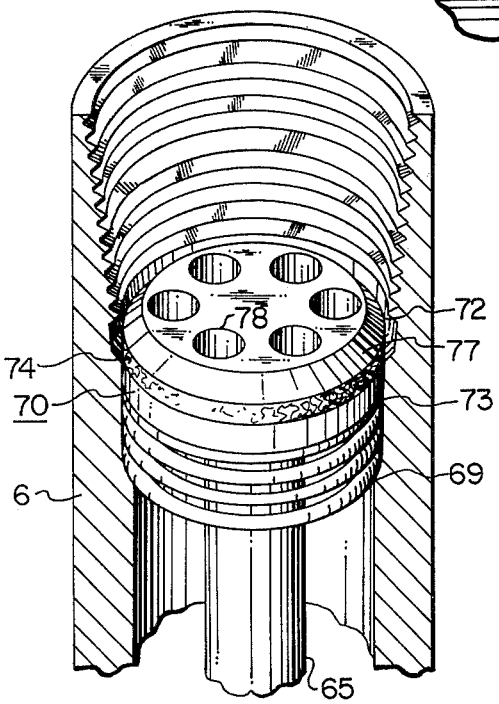
FIG. 5 is a perspective view, partly in section, of the upper end portion of said drill collar or sub with said second combination electrical connector-insulator-packer means mounted therein.
Figure 6:
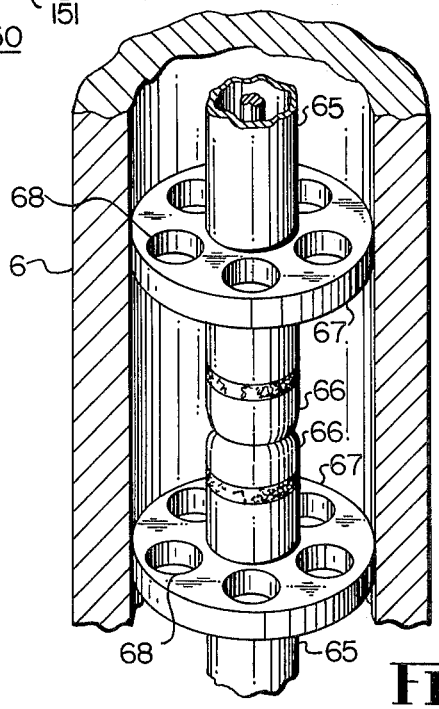
FIG. 6 is a view, similar to FIG. 5, showing the spiders for spacing said instrument means from the internal wall of said drill collar or sub.

The mounting of more or less conventional sondes or other instruments 65 in the drill collar 6 of the drill string 1 is illustrated in FIGS. 2, 5, 6, wherein the sondes or instruments are shown as elongate cylinders of relative small diameter and interconnected to each other by suitable fittings or plugs 66. Suitable annular spiders 67, having flow openings 68 extending therethrough, are provided for centering the sondes 65 within the drill collar which is internally recessed below the inner end of its upper screwthreaded box or socket to provide an annular shoulder 69 for supporting a combination electrical connector-insulator-packer plug 70. A helical spring 71 is interposed between the shoulder 69 and plug 70 for urging said plug upwardly when the pin 8 of the male coupling collar 4 is screwthreaded into the upper box of the drill collar 6 as shown in FIG. 2.

The combination plug comprises upper and lower disks 72, 73, of electrically conductive metal, having a complementary disk 74 of elastic electrical insulating or dielectric material confined therebetween. An axial electrically conductive pin 75, of similar metal, depends from the upper disk 72, through the disks 73 and 74 into the sonde body 65. As shown at 76 in FIG. 2, the lower metal disk 74 has an axial bushing of dielectric material extending therethrough and surrounding the metal pin 75 for electrically insulating said disk from said pin. The lower disk is adapted to snugly engage the bore of the drill collar between its annular shoulder 69 and upper screwthreaded box. Due to the internal bevel 13 at the outer extremity of the pin 8 of the male coupling collar 4 screwthreaded into the upper box of the drill collar 6, the periphery 77 of the upper metal disk 72 is bevelled for complementary engagement with the flared lower extremity 21 of the sheathed tube 20. The compression of the spring maintains the positiveness of the electrical contact between the plug 70 and the tube and deforms the elastic dielectric disk 74 into sealing engagement with the tube extremity 21 and liner sheath extremity 31 to electrically insulate the tube 20 from the pipe length. As shown at 78 in FIG. 5, a multiplicity of axially-aligned flow openings extend through the disks 72, 73, 74.

Figure 9:
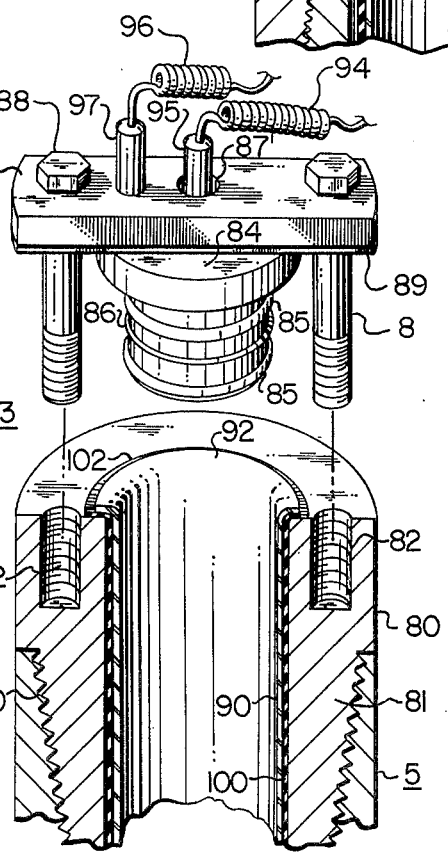
FIG. 9 is an exploded perspective view, partly in section, of the upper extremity of the female coupling collar at the upper end of the uppermost pipe length of said drill string, with a male or pin type flanged fitting or nipple screwthreaded into the upper box of said collar, and an electrical connector fitting for attachment to said nipple so as to illustrate a type of surface connection between the upper ends of said inner and outer conductors of said electrical signal transmission system, FIG. 10 (second sheet of drawings) is a transverse vertical sectional view, on an enlarged scale, of the circled portion 10 of FIG. 1, showing a portion of one of the external annular beads provided by the outward deformation of each inner conductor tube into the internal annular recess between each end of each drill pipe length and the coupling collar secured thereto, as well as the filling of said recess.

After coupling of the pipe lengths 2 as shown in FIGS. 1, 2, or prior thereto, it is desirable to test the electrical coaxial conductor assembly or system and/or the electrical coaxial conductor unit provided by each pipe length 2 after one of the tubes 20 is mounted and deformed therein as described hereinbefore. Electrical transmission of signals and power and/or testing of the system may be performed before, during or after the installation of the drill string in or removal from the borehole. For this electrical transmission and/or testing, an annular flanged nipple 80 (FIGS. 1, 9, 12) is screwthreaded into the outer or upper box 10 of the uppermost female coupling collar 5 and this nipple is similar to the lower portion of one of the male coupling collars 4, in that, its inner or lower portion 81 resembles the pin or male end 8 of said collar. A multiplicity of screwthreaded outwardly or upwardly directed openings 82 extend axially of the flange of the nipple 80 and a bevel 83, similar to the bevel 13 of the male coupling pin shown in FIGS. 1, 2, 7, 11, is provided at the interior of the outer extremity of the pin end 81 (FIG. 1) of the flanged nipple 80.

The bore or interior of the flanged nipple is lined with an inner electrical conductor tube 90 of short length and with an interposed insulating sleeve or sheath 100, which are substantially identical to the tube 20 and liner sheath 30 of each pipe length 2. As shown 91 and 101 in FIG. 1, the respective inner or lower extremities of the short tube 90 and the liner sheath 100 are flared into conformity with the bevel 83 of the nipple 80. At the respective upper or outer extremities 92, 102 thereof, the short tube and liner sheath are flared or deformed laterally outward so as to overlie the inner peripheral margin of the top or outer face of the nipple. Also, the sheath 100 is of slightly greater length than the tube 90 so as to project beyond the ends thereof and assist in the insulation of said tube ends from the adjacent surfaces of the nipple 80. Although not illustrated, the sheathed tube is adapted to be flared at its end portions and deformed therebetween radially outward into contiguous conformity with the nipple in a similar manner to the sheathed tube of each pipe length 2.

Figure 12:
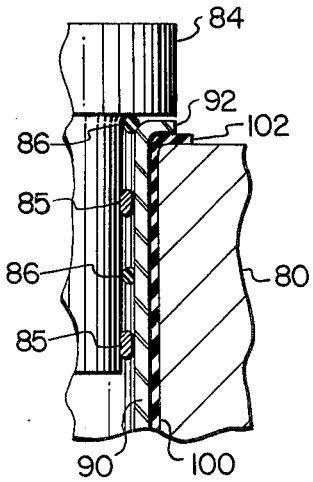
FIG. 12 is a view, similar to FIGS. 10 and 11, of the circled portion 12 of FIG. 1, showing the electrical contact and sealing engagement of the surface connection of FIGS. 1 and 9 with the uppermost inner conductor tube mounted in the bore of the flanged nipple screwthreaded into said upper box of said uppermost female coupling collar of said drill string, and FIG. 13 (2nd sheet of drawings) is a fragmentary longitudinal sectional view of a portion of a pipe joint having an external clamp-type coupler illustrating the invention applied thereto.

One of the annular plugs 50, with its annular body 51 of elastic electrical material and its electrical conductor 52, are adapted to be mounted in the bottom or inner end of the outer or upper box 10 of the aforesaid uppermost female coupling collar 5 for engagement and deformation by the inner or lower extremity of the pin 81 of the nipple as described hereinbefore relative to the pin 8 of the male coupling collar 4. A flanged plug 84, of electrically conductive metal, is adapted to be inserted within the bore of the short tube 90 and one or more annular elements or rings 85, of similar or higher electric conductivity, are carried by the exterior of the plug for engagement with said tube bore so as to electrically connect said plug to said tube. For sealing off between this tube and plug 84, annular elements or rings 86, of elastic dielectric material, are mounted on the exterior of said plug between the metal rings 85 as well as between the flange of the nipple 80 and the outer or upper flared extremity 92 of said tube as best shown in FIG. 12.

An oblong flat bar 87, of electrically conductive metal, overlies and is disposed transversely of the flanged plug 84 and has an opening 87' extending through its medial portion in axial alignment with the longitudinal axis of said plug. The bar 87 is adapted to be detachably fastened to the flanged nipple 80 by cap screws 88 screwthreadly engaged in the openings 82 of said nipple so as to clamp the plug 84 against displacement as well as provide an electrical connection between said nipple and plug. A complementary pad 89, of dielectric material and interposed between the flanged plug and oblong bar, electrically insulates said plug from said bar (FIG. 1). The insulator pad 89 has a medially disposed opening 93 communicating with the opening 87' of the bar 87 and with an axial relatively small diameter opening 84' in the plug 84. An electrical lead 94 from a suitable source (not shown) has its end fitting 95 extending through the respective openings 87', 93 of the bar and insulator pad and frictionally engaged in the opening 84' of the flanged plug. The other lead 96 of the electrical circuit has its fitting 97 engaged in an opening 98 formed in the bar 87. As will be apparent, electric power or signals may be transmitted, to and from, between the surface and the sondes or other means mounted in the drill collar 6 through the electrical coaxial conductor assembly or system described hereinbefore. It is a relatively simple matter to electrically connect the uppermost female coupling 5 to a rotary table and the sheathed tube 90 therein to a slip ring as disclosed by the expired Polk patent, supra, after removal of the flanged nipple 80 and other testing equipment.

Figure 13:
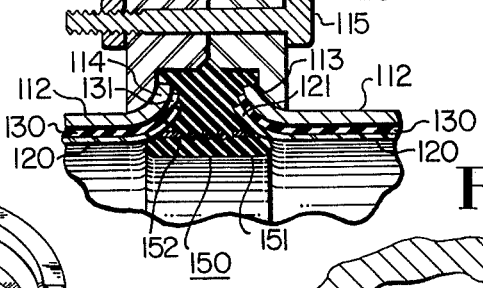

It is readily apparent that this invention may be applied to any tubular fluid conductor composed of lengths of electrically conductive pipe having their adjacent ends connected in spaced relationship by external couplers. FIG. 13 illustrates an external coupler 110, of the clamp type, having a pair of annular flat collars or rings 111 adapted to be mounted on the adjacent end portions of adjacent lengths of pipe 112, the ends of which are flared as shown at 113. Each coupler ring 111 has an internal bevelled or transversely arcuate peripheral margin 114 complementary to the flared ends 113 of each pipe 112 for mating engagement therewith when the rings are connected together by bolts 115 and nuts 116. Although not shown, the rings may be of the split type so as to permit mounting thereof after flaring the pipe ends. A cylindrical tube 120, substantially identical to the tube 20 described hereinbefore, is adapted to be mounted within each pipe 112 after being enveloped within a complementary sheath or liner 130 which is substantially identical to the sheath 30 and which is shrunk fit on said tube 120 in the same manner.

As shown at 121 and 131, the ends of the tube 120 and sheath 130 are flared into conformity with the interiors of the flared pipe ends 113 and then the remainder of said tube and sheath is expanded or deformed outwardly into conformity with the interior of the pipe, whereby said tube and pipe may function as inner and outer electrical conductor units of an electrical coaxial conductor assembly. It is noted that each liner sheath 130 is of slightly greater length than its tube 120 so as to ensure that the ends of said tube are adequately insulated from the pipe 112. Also, each tube and liner sheath are of slightly greater length than interior of its pipe, which interior of said pipe terminates inwardly of its flared ends 113, whereby the tube and liner sheath extremities 121, 131 project beyond the ends of said pipe interior for overlying conformation with said flared pipe ends. For sealing off between the adjacent pipe ends 113 as well as between the adjacent tube ends 121, an annular plug or ring 150 (substantially identical to the plug 50) is provided and comprises a substantially identical annular body 151 adapted to be deformed into positive engagement with the contiguous internal surfaces of said pipe ends as well as of the adjacent tube and sheath ends and of the coupler rings 111. In addition, the body 151 of the plug 150 electrically insulates the adjacent ends of the pipe and tubes from each other. An electrical conductor 152, substantially identical to the electrical conductor 52, is embedded or molded in the inner peripheral portion of the plug body for contact with the adjacent flared extremities 121 of adjacent tubes 120 so as to provide an electrical connection therebetween. It is pointed out that the flaring of the tube ends amplifies the surficial area thereof exposed for contact with the ends of the conductor 152.

I claim:

1. A method of constructing an electrical coaxial conductor assembly to provide an electrical transmission system for a tubular fluid conductor composed of electrically conductive pipe and means externally connecting the adjacent ends of adjacent lengths of pipe in spaced relationship which comprises utilizing the pipe and external connecting means as an outer electrical conductor for the coaxial conductor assembly, forming an inner electrical conductor for said coaxial conductor assembly of thin ductile electrically conductive tubes having less diameter and slightly greater length than the interior of said pipe of the outer electrical conductor, snugly enveloping the exterior of each tube of the inner electrical conductor in elastic dielectric material, positioning each enveloped tube within each pipe of said outer electrical conductor, flaring the end portions of each tube into contiguous conformity with the interior of each pipe and over the transverse faces of its ends so as to prevent relative longitudinal displacement therebetween, deforming each tube radially outward between its flared end portions into contiguous conformity with the interior of each pipe, the elasticity of the enveloping dielectric material permitting expansion thereof into sealing engagement with each pipe upon said flaring and outward radial deformation of each tube so as to electrically insulate each pipe from each tube throughout the length of said material, the adjacent flared end portions of adjacent tubes of said inner electrical conductor being spaced from each other upon coupling of the adjacent ends of adjacent lengths of pipe in spaced relationship, electrically insulating said adjacent end portions of coupled pipe from said adjacent tube ends by positioning elastic dielectric annular means between and in engagement with said tube ends for deformation into sealing engagement with the contiguous surfaces of said tube and pipe ends upon coupling of said pipe, and electrically connecting adjacent flared tube ends by embedding electrical contact means in the inner peripheral portions of the elastic dielectric annular means.

2. The method defined in claim 1 wherein the means for externally connecting the ends of adjacent lengths of the pipe of the outer electrical conductor includes a coupling member secured to the exterior of at least one of the end portions of each pipe of the outer electrical conductor and having an internally screwthreaded box portion for mating engagement with an externally screwthreaded pin of an adjacent length of said outer electrical conductor pipe whereby one of the ends of each tube of the inner electrical conductor terminates at the inner extremity of the box portion of the coupling member secured to said exterior of said one of said end portions of said pipe, each elastic dielectric annular means being positioned in said inner extremity of said box portion of each coupling member for engagement with the pin of the adjacent length of said pipe.

3. The method of claim 2 wherein the external mounting of the coupling member on the exterior of at least one of the end portions of each pipe of the outer electrical conductor creates an internal annular recess between said end of said pipe and said coupling member secured thereto, each tube of the inner electrical conductor being deformed outwardly into the annular recess of each pipe so as to assist in the anchoring of said tube.

4. The method defined by claim 1 wherein the elastic dielectric material which envelopes each tube of the inner electrical conductor is extended a slight distance beyond the ends of said tube so as to ensure electrical insulating of said tube ends from the contiguous end portions of the pipe of the outer electrical conductor in which said tube is positioned.

5. The method defined by claim 1 wherein fluid under pressure is utilized to deform each tube of the inner electrical conductor between its flared end portions radially outward into contiguous conformity with the interior of each pipe of the outer electrical conductor.

6. The method defined by claim 1 wherein the radially outward deformation of each tube of the inner electrical conductor between its flared ends into contiguous conformity with the interior of each pipe of the outer electrical conductor includes closing the ends of said tube, and applying fluid under pressure to the interior of said closed tube.

7. A method of constructing an electrical coaxial conductor unit for use in a tubular fluid conductor composed of electrically conductive pipe having means mechanically connecting the adjacent ends of adjacent lengths of pipe in spaced relationship which comprises utilizing the pipe and connecting means as the outer electrical conductor of the unit, forming an inner electrical conductor for said unit of a thin ductile electrically conductive tube having less diameter and slightly greater length than the interior of said pipe of said outer electrical conductor, snugly enveloping the exterior of the tube of the inner electrical conductor in elastic dielectric material, positioning said enveloped tube within said pipe, flaring the end portions of said tube into contiguous conformity with the end portions of said pipe and the transverse faces of its ends so as to anchor said tube to said pipe, and deforming said tube radially outward between its flared end portions into contiguous conformity with the interior of said pipe, the elasticity of the enveloping dielectric material permitting expansion thereof into sealing engagement with said pipe interior upon said flaring and outward radial deformation of said tube so as to insulate said pipe from said tube throughout the length of said material.

8. The method defined by claim 7 wherein fluid under pressure is utilized to deform the tube of the inner electrical conductor between its flared ends radially outward into contiguous conformity with the interior of the pipe of the outer electrical conductor.

9. The method defined by claim 7 wherein the radially outward deformation of the tube of the inner electrical conductor between its flared end portions into contiguous conformity with the interior of the pipe of the outer electrical conductor includes closing the ends of said tube, and applying fluid under pressure to the interior of said closed tube.

10. The method defined by claim 7 wherein the elastic dielectric material which envelopes each tube of the inner electrical conductor is extended a slight distance beyond the ends of said tube so as to ensure electrical insulating of said tube ends from the contiguous end portions of the pipe of the outer electrical conductor in which said tube is positioned.

11. In a tubular fluid conductor composed of electrically conductive pipe and means externally connecting the adjacent ends of adjacent lengths of pipe in spaced relationship, an electrical transmission system including coaxial electrical conductor means having inner and outer tubular electrical conductors, the outer electrical conductor being composed of the pipe and external connecting means, the inner electrical conductor comprising tubes of electrically conductive material mounted in and complementary to each pipe of the outer electrical conductor, a sheath of dielectric material complementary to and enveloping each tube of the inner electrical conductor for electrically insulating the exterior of said tube from each pipe of said outer electrical conductor, each inner conductor tube and its sheath being of slightly greater length than the interior of each outer conductor pipe whereby the extremities of said tube and sheath project slightly beyond the ends of said pipe, said projecting extremities of each inner conductor tube and its sheath being flared over the transverse faces of the ends of each outer conductor pipe so as to anchor said tube and sheath against longitudinal displacement relative to said pipe, an annular body of elastic dielectric material adapted to be mounted between the adjacent ends of adjacent pipe so as to be engaged and deformed by said adjacent pipe ends into fluid-tight sealing engagement therewith as well as with adjacent flared extremities of said tubes and sheaths, and resilient electrical contact means embedded in the inner peripheral portion of each annular elastic dielectric body and having portions exposed for engagement with said adjacent flared extremities of said adjacent inner conductor tubes.

12. An electrical transmission system as defined in claim 11 wherein the means for externally connecting the adjacent ends of adjacent lengths of the outer electrical conductor pipe in spaced relationship comprises a coupling member secured to the exterior of at least one of the end portions of each pipe of the outer electrical conductor and having an internally screwthreaded box portion for mating engagement with an externally screwthreaded pin of an adjacent length of outer conductor pipe whereby one of the end portions of each tube of the inner electrical conductor terminates at the inner extremity of the box portion of the coupling member secured to said exterior of said tube end portion, each annular body of elastic dielectric material being mounted in said inner extremity of each coupling member box portion for engagement with the pin of the adjacent length of pipe of said outer electrical conductor.

13. An electrical transmission system as defined in claim 12 wherein the external mounting of the coupling member on the exterior of at least one of the end portions of each pipe of the outer electrical conductor creates an internal annular recess between said end of said pipe and said coupling member secured thereto, each tube of the inner electrical conductor and its sheath being deformed outwardly into the annular recess of each pipe so as to assist in the anchoring of said tube.

14. An electrical transmission system as defined in claim 11 wherein each sheath of dielectric material is of slightly greater length than the tube of the inner electrical conductor which it envelopes whereby its ends projec beyond the ends of said tube so ensure the electrical insulation of the latter from the contiguous end portions of the pipe of the outer electrical conductor in which said tube is mounted.

15. An electrical transmission system as defined in claim 11 wherein the electrically conductive material of each tube of the inner electrical conductor is of sufficient thinness and ductility to permit flaring of the extremities of said tube and radially outward deformation of said tube between its flared extremities into contiguous conformity with each pipe of the outer electrical conductor after positioning of said tube and its enveloping sheath of elastic dielectric material in said pipe.

16. An electrical transmission system as defined in claim 11 wherein each sheath of dielectric material is elastic so as to be capable of being shrunk fit upon each tube of the inner electrical conductor as well as expansion upon flaring of the extremities of said sheath with said tube.

17. An electrical coaxial conductor unit for an electrical transmission system adapted for use in tubular fluid conductors including a length of electrically conductive pipe forming the outer electrical conductor of the coaxial unit, a tube of electrically conductive material mounted in and complementary to the pipe of said outer electrical conductor, a sheath of dielectric material complementary to and enveloping the tube for electrically insulating the exterior of said tube from said pipe of said outer electrical conductor so as to permit said tube to form the inner electrical conductor of said coaxial unit, said tube of said inner electrical conductor and its sheath conforming to the contour of and being coextensive with the interior of said pipe of said outer electrical conductor and the transverse faces of its ends whereby the end portions of said tube and sheath are flared over said transverse end faces of said pipe so as to anchor said tube and sheath against longitudinal displacement relative to said pipe, the flaring of said end portions of said tube providing amplified surficial areas for electrical contact axially of said pipe when complementary lengths of pipe are coupled thereto.

18. An electrical coaxial conductor unit as defined in claim 17 wherein the material of the tube of the inner conductor is of sufficient thinness and ductility to permit the flaring of the end portions thereof as well as radial outward deforming of said tube between its end portions into contiguous conformity with the interior of the pipe of the outer conductor of said coaxial unit.

19. An electrical coaxial conductor unit as defined in claim 17 wherein the sheath of dielectric material is elastic so as to be capable of being shrunk fit upon the tube of the inner electrical conductor as well as expansion upon flaring of the end portions of said sheath with said tube.

20. An electrical coaxial conductor unit as defined in claim 17 wherein the pipe of the outer electrical conductor has external coupling means secured to the exterior of at least one of its end portions and creating an internal annular recess between said end portion of said pipe and the coupling means secured thereto, the tube of the inner electrical conductor and its sheath being deformed outwardly into each of the annular recesses of each outer conductor pipe so as to assist in the aforesaid anchoring of said inner conductor tube.

21. In an electrical coaxial conductor assembly of an electrical transmission system for a tubular fluid conductor composed of electrically conductive pipe and means externally connecting the adjacent ends of adjacent lengths of pipe, the pipe and external connecting means comprising the outer electrical conductor of the electrical coaxial conductor assembly, the inner electrical conductor of said assembly being composed of an electrically conductive coextensive tube mounted in each pipe spaced insulated relationship;

means for electrically connecting each of the adjacent ends of adjacent tubes and for insulating each of said adjacent tubes from the adjacent ends of adjacent pipe including an annular body of elastic dielectric adapted to be mounted between said adjacent pipe ends so as to be engaged and deformed thereby into fluid-tight engagement with said pipe ends and with said adjacent tube ends, and resilient electrical contact means embedded in the inner peripheral portion of each annular elastic body and having portions exposed for engagement with adjacent tube ends.

* * * * *